US006119901A

United States Patent [19]

Hanna

[11] Patent Number: 6,119,901

[45] Date of Patent: Sep. 19, 2000

[54] ROTATABLE COUPLING FOR FLUID DISPENSER

[75] Inventor: Emmanuel A. Hanna, Lakeview Terrace, Calif.

[73] Assignee: Bobrick Washroom Equipment, Inc., North Hollywood, Calif.

[21] Appl. No.: 09/325,105

[22] Filed: Jun. 3, 1999

[51] Int. Cl.[7] ..... B67D 5/42

[52] U.S. Cl. ..... 222/321.1; 222/372

[58] Field of Search ..... 222/321.1, 321.7, 222/321.8, 372, 382, 383.1, 383.3

[56] References Cited

U.S. PATENT DOCUMENTS

| | | | |
|---|---|---|---|
| 1,229,556 | 6/1917 | Watrous | 222/321.8 X |
| 2,772,116 | 11/1956 | Dobkin | 222/321.7 X |
| 3,078,471 | 2/1963 | Knibb | 222/321.1 X |
| 4,436,125 | 3/1984 | Blenkush | 222/321.7 |
| 5,373,973 | 12/1994 | Foster | 222/382 X |
| 5,476,197 | 12/1995 | Lawrence et al. . | |
| 5,632,414 | 5/1997 | Merriweather, Jr. | 222/381 X |

*Primary Examiner*—Kenneth Bomberg
*Attorney, Agent, or Firm*—Pretty, Schroeder & Poplawski, P.C.

[57] ABSTRACT

A fluid dispenser such as a soap dispenser or the like. The dispenser includes a sleeve and a pump rotatably disposed inside the sleeve. A swivel is substantially fixed to the pump and rotatable inside the sleeve. The dispenser is configured so that fluid is drawn from a reservoir, through the swivel and into the pump. From the pump, the fluid is dispensed through a spout to the user.

18 Claims, 2 Drawing Sheets

ROTATABLE COUPLING FOR FLUID DISPENSER

BACKGROUND OF THE INVENTION

The invention relates to coupling apparatus for use in a fluid handling system. More specifically, the invention provides an improved coupling for use between a fluid dispenser such as a soap dispenser or the like and a reservoir holding a quantity of the dispensed fluid.

Washing facilities in large restroom installations, such as those found in commercial and public buildings, often include built-in fluid dispensers for dispensing liquid soap to the patrons of the establishment. One common type of dispenser includes a hand-operated pump in which soap is dispensed through a spout when the user presses downward on a piston cap or a similar member disposed at the top of the dispenser. A dispenser of this general type is disclosed in U.S. Pat. No. 5,476,197 ("the '197 patent"). This type of dispenser is most commonly built into or located adjacent the sinks or washbasins of the restroom facility.

Soap dispensers of this type typically draw soap from a reservoir located in close proximity to, often directly beneath, the pump and dispenser spout. It is desirable in a dispenser of this type that the spout be rotatable about a vertical axis extending generally through the center-line of the pump. Rotatability of the spout is desirable both for the convenience of the user, and because it allows for simpler and more convenient assembly and installation of the dispenser. This latter feature is more fully described in the '197 patent.

Rotatability of the dispensing spout has heretofore required that the reservoir from which soap is drawn be situated along the rotational axis of the dispenser so that regardless the spout's position an inlet of the pump remains in constant fluid communication with the reservoir. This configuration is illustrated in FIG. 1 (adapted from FIG. 1 of the '197 patent), where the reservoir is depicted directly below the dispenser and centered along the rotational axis of the spout assembly.

It may frequently be desirable to locate the fluid reservoir off the rotational access of the spout. In some cases it may be desirable to locate the reservoir a fair distance from the pump, or even to use a single, common reservoir to provide fluid to several pumps at different washbasins. In such a case, flexible tubing may be used to connect an outlet of the fluid reservoir to an inlet at the bottom of the pump assembly. This presents a difficulty, however, in that rotation of the spout causes a corresponding rotation of the inlet at the bottom of the pump. This rotation can lead to kinking in the tubing that connects the reservoir to the pump, and a concomitant restriction or prevention of fluid flow from the reservoir. In an extreme case, the tubing may pull free of the pump inlet, resulting in spillage and loss of fluid from the apparatus. It would thus be desirable to provide a coupling apparatus for providing fluid communication between a remote reservoir and a fluid pump of the type having a rotatable spout, in which the spout could freely rotate without any potential for restriction or loss of fluid communication between the pump assembly and the reservoir.

SUMMARY OF THE INVENTION

The invention is embodied in a novel fluid dispenser such as a soap dispenser or the like. The dispenser includes a pump disposed within and rotatable inside a sleeve. A swivel is substantially fixed with respect to the pump and rotatable with respect to the sleeve. The swivel includes a flow channel in fluid communication with the reservoir and the pump, and apparatus is provided that is configured to draw fluid from the reservoir, through the flow channel and into the pump.

In a preferred embodiment, fluid communication between the flow channel and the pump is provided by a connecting tube between them. In that embodiment, a fluid seal is formed by an O-ring disposed between the exterior of the swivel and an interior of the sleeve that houses the pump. In preferred embodiments the sleeve is formed of two distinct pieces, a primary sleeve portion, and a sleeve extension. In this embodiment the two pieces of the sleeve are held together by a locking screw. In the preferred embodiment the primary sleeve portion houses the pump and the sleeve extension houses the swivel.

Rotatability of the swivel inside the sleeve provides for rotation of the pump and an associated dispenser spout while maintaining fluid communication with a reservoir holding a quantity of the fluid being dispensed. The reservoir may be located remotely and away from the axis of rotation of the pump. These features provide for a novel fluid dispenser that is easily assembled and installed, and easy to refill or repair. Other features and advantages of the present invention will become apparent from the following detailed description of the preferred embodiment, taken in conjunction with the accompanying drawings, which illustrate by way of example the principles of the invention.

BRIEF DESCRIPTION OF THE DRAWINGS

The construction and operation of the invention are described in detail in conjunction with the figures included herewith, in which.

DESCRIPTION OF THE PREFERRED EMBODIMENTS

Figure 1:
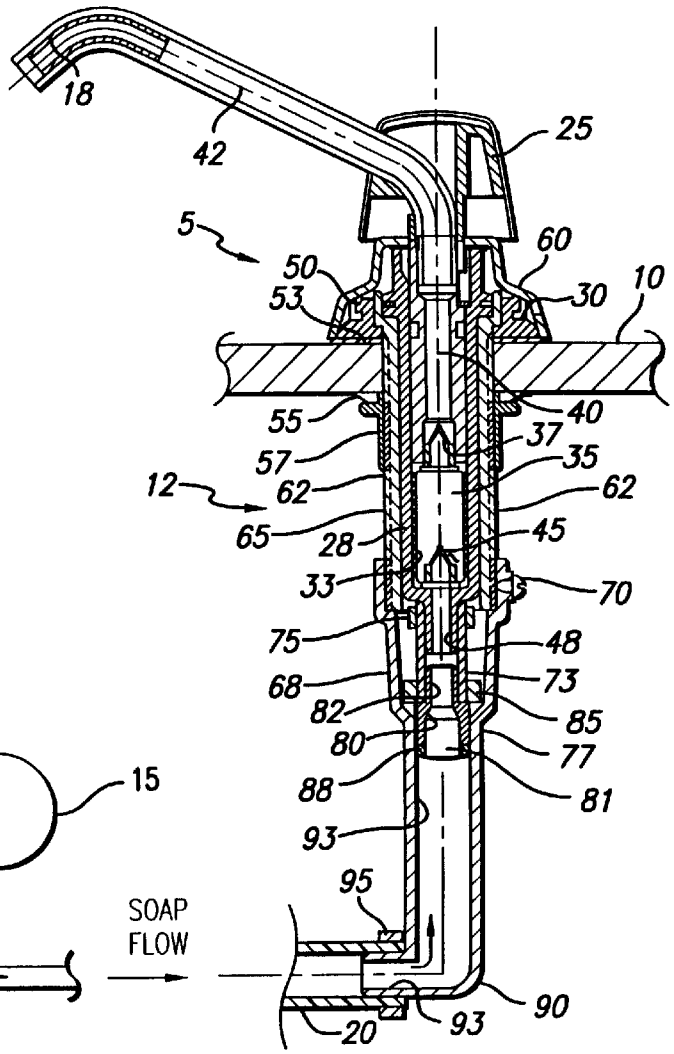
FIG. 1 PRIOR ART
FIG. 1 depicts a conventional soap dispenser of the type including a rotatable pump for dispensing soap from a reservoir disposed beneath the dispenser.
Figure 1:
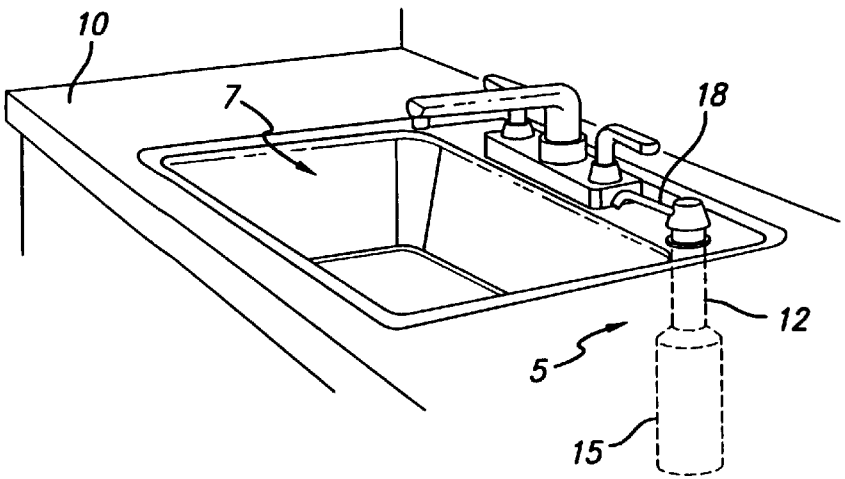
FIG. 1 PRIOR ART

FIG. 1 depicts a conventional soap dispenser installation of the type known in the art. A soap dispenser 5 is mounted adjacent a washbasin 7, installed in a countertop 10. The soap dispenser comprises a pump 12 operable to draw soap from a reservoir 15. The soap dispenser further includes a spout 18, from which soap pumped from the reservoir is dispensed. For ease of installation and the user's convenience, the spout is rotatable along with the pump. A flexible supply line (not shown) connects an inlet (not shown) at the bottom of the pump with soap in the reservoir. Because the reservoir is situated directly beneath the pump along the pump and spout's axis of rotation, the flexible supply line maintains constant fluid communication between the pump and the reservoir regardless of the rotational position of the pump.

Figure 2:
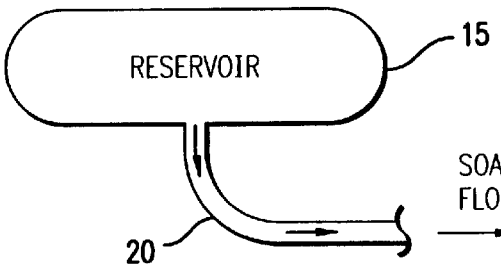
FIG. 2 is a sectional illustration of an improved soap dispenser embodying the invention.

FIG. 2 depicts a novel soap dispenser 5 incorporating the present invention. To dispense soap from the dispenser, the user presses down on a shell 22, which overlies a piston cap 25. This motion operates a pump 12. The pump comprises a cylinder 28, inside of which is received a piston 30.

When the user presses down on the shell 22, the piston cap 25 forces the piston 30 downward against the resistance of a coil spring 33. As the piston is forced down inside the cylinder 28, soap is forced from a first pumping chamber 35 through a first one-way valve into a second pumping chamber. Entry of the soap into the second pumping chamber from the first pumping chamber forces soap already inside the second pumping chamber up through a dispensing tube 42 and out of the spout 18.

When the user releases the shell 22, the coil spring 33 presses the piston 30 back up inside the cylinder 28. As the piston moves upward, suction is produced inside the first pumping chamber 35. This suction draws soap through a second one-way valve 45 which resides just above a cylinder inlet 48 at the lower end of the cylinder 28. Soap is drawn through the cylinder inlet from a supply line 20 out of a reservoir 15. By operating the pump in this manner repeatedly, the user may dispense a desired quantity of soap from the dispenser 5 onto the user's hands.

For convenience and ease of operation, the dispenser 5 is generally mounted atop a counter 10. The dispenser is fastened securely to the counter by an upper nut 50, an upper gasket 53, a lower gasket 55, and a lower nut 57. For esthetic purposes and ease of cleaning, a cover 60 is typically disposed over the upper nut. Usually, the pump 12 is housed inside a sleeve 62. In the embodiment shown in FIG. 2, the sleeve comprises a primary sleeve portion 65, and a sleeve extension. In this embodiment, the sleeve extension is secured to the primary sleeve portion by means of a locking screw 70.

The choice of the terms "primary sleeve portion" and "sleeve extension" in this description and the appended claims in for convenience only. Nothing is to be implied regarding the relative sizes, material strengths, or manner of construction or joinder of these parts to form the overall sleeve.

These terms imply only that the primary sleeve portion and the sleeve extension together form the sleeve. These may be two distinct parts which are, as in the preferred embodiment, removably joined together, or two distinct parts fixed permanently together. The sleeve may even be a single part, wherein the terms "primary sleeve portion" and "sleeve extension" are merely two regions of a single-piece "sleeve."

In the preferred embodiment described herein, the primary sleeve portion 65 and the sleeve extension 68 are removably joined to one another by a locking screw 70, with the junction between these parts being situated near one end of the pump 12, where the connecting tube 73 joins the pump. This configuration provides ease of assembly and disassembly if the pump or swivel should require maintenance, replacement or repair.

A connecting tube 73 is secured over the cylinder inlet 48. A first snap clamp 75 secures a fluid-tight engagement between the connecting tube and the cylinder inlet. The connecting tube leads from the cylinder inlet to a swivel 77. The swivel comprises a swivel body 80, which includes a flow channel 81 through the swivel, and a swivel outlet 82 in fluid communication with the flow channel. The connecting tube is secured in fluid-tight engagement over the swivel outlet of the swivel body by a second snap clamp 85. The material of the connecting tube should be somewhat pliable for ease of assembly, but sufficiently rigid so that the swivel is substantially fixed with respect to the pump. The swivel will thus rotate inside the sleeve 62 in response to rotation of the spout 18 by the user.

An O-ring 88 provides a fluid-tight seal between the swivel body 80 and an interior surface of the sleeve extension 68. The fit between these parts must be sufficiently tight to provide a substantially fluid-tight seal, while still allowing rotation of the swivel 77 inside the sleeve extension.

The sleeve extension 68 depicted in FIG. 2 includes an elbow 90 and a sleeve extension inlet 93. The supply line 20, which conducts soap from the reservoir 15, is secured over the sleeve extension inlet with a third snap clamp 95. The third snap clamp fits over the supply line with sufficient tightness so that a substantially fluid-tight seal is formed between the supply line and the sleeve extension inlet.

The embodiment depicted in FIG. 2 retains the principal advantages of the prior art dispensers. The sleeve 62 is securely fastened and fixed to the counter 10. The pump, however, including the spout 18, the cylinder 28, and the piston 30, is rotatable inside the sleeve. Rotatability of the pump confers the same ease of assembly and convenience of use as that of the dispenser described in the '197 patent.

The embodiment shown in FIG. 2, however, has a further advantage in that the reservoir 20 need not be located directly below the pump 12 or on the pump's rotational axis. In fact, the reservoir may be situated remotely at some distance away from the dispenser. If desired, a single high-capacity reservoir can serve multiple dispensers. This confers greater flexibility in that the reservoir may be located in a wider range of locations. Additionally, refilling or servicing the reservoir can be made more convenient, particularly where a single reservoir is configured to serve multiple dispensers.

The sleeve extension 68, being fixed by the lock screw 70 to the primary sleeve portion 65, remains immobile regardless of any rotation of the pump 12 inside the sleeve 62. This eliminates any danger of the supply line 20 becoming kinked or being pulled off the sleeve extension inlet 93 as the pump rotates.

Figure 3:
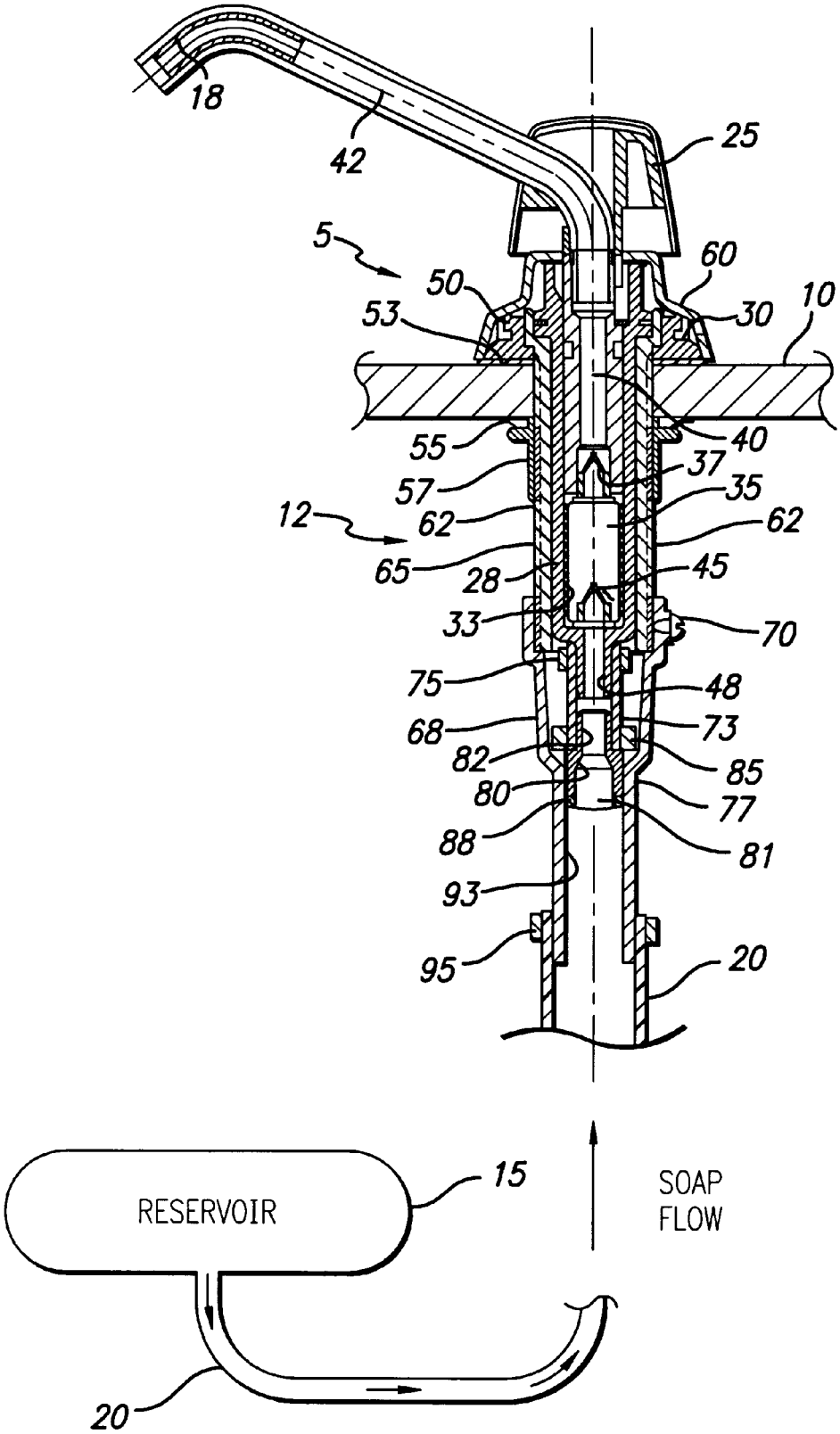
FIG. 3 is a sectional illustration of an alternative embodiment of an improved soap dispenser embodying the invention.

FIG. 3 illustrates an alternative embodiment of a soap dispenser depicted in FIG. 2 and described above. The embodiment shown in FIG. 3 is identical in almost every respect to that of FIG. 2. In the embodiment of FIG. 3, the sleeve extension 68 is straight and without the elbow 90 of that shown in FIG. 2. The sleeve extension in this form is simpler and somewhat more easy to manufacture than the elbow configuration of FIG. 2. The simpler form of FIG. 3 may be preferred in some cases for that reason.

Preferred embodiments of the invention have been described above in detail for the purpose of illustrating its construction and operation. However, substantial modification may be made to these embodiments without departing from the principles of the invention and the scope of the invention as claimed is not limited to the exemplary embodiments described above.

By way of example, flow of fluid through the pump could be quite readily reversed. The embodiments described herein are configured to draw fluid from a reservoir, through the swivel, from the swivel into the pump, and from the pump out through a spout. Flow could readily be reversed, however, without much more than a reversal of the one way valves and minor reconfiguration of some of the other parts. Such a pump assembly could readily be envisioned, wherein fluid is drawn into the pump through a spout or an exterior intake, through the pump and from there through the swivel before being discharged into a reservoir or otherwise outside of the pump assembly. Where this modification is made, the invention's principles of operation remain generally the same, and the invention is still used. In such a case, though, the meaning of terms such as "inlet," as used herein, will be the opposite of the normal meaning, i.e., fluid will be conducted out through the inlet.

Further modification, reconfiguration or development of the embodiments described herein may occur to those skilled in the art. The scope of the invention should therefore be determined by reference to the appended claims, along with the full scope of equivalents to which those claims are legally entitled.

What is claimed is:

1. A fluid dispenser for dispensing fluid from a reservoir, the dispenser comprising:

a sleeve defining an interior volume in fluid communication with the reservoir;

a pump disposed and rotatable within the interior volume of the sleeve;

a swivel substantially fixed with respect to the pump and rotatable with respect to the sleeve; wherein the swivel includes structure defining a flow channel in fluid communication with the reservoir and the pump; and apparatus configured to draw fluid from the reservoir, through the flow channel of the swivel, and into the pump.

2. The fluid dispenser of claim 1, further comprising a connecting tube between the swivel and the pump, wherein fluid communication between the flow channel of the swivel and the pump is provided by the connecting tube.

3. The fluid dispenser of claim 1, wherein a fluid seal is formed between the swivel and an interior surface of the sleeve.

4. The fluid dispenser of claim 3, wherein the fluid seal between the swivel and the interior surface of the sleeve is provided by an O-ring.

5. The fluid dispenser of claim 1, wherein the sleeve comprises a primary sleeve portion and a sleeve extension joined to the primary sleeve portion.

6. The fluid dispenser of claim 5, wherein the pump is disposed inside the primary sleeve portion, and wherein the swivel is disposed inside the sleeve extension.

7. The fluid dispenser of claim 1, wherein the swivel comprises a swivel body and a swivel outlet, and wherein the swivel outlet is in fluid communication with the pump.

8. The fluid dispenser of claim 5, wherein each of the primary sleeve portion and the sleeve extension is a separate component, and wherein the primary sleeve portion and the sleeve extension are assembled together to form the sleeve.

9. The fluid dispenser of claim 8, further comprising a locking screw operable to hold the primary sleeve portion and the sleeve extension together.

10. An improved fluid dispenser of the type comprising a pump, the pump including a cylinder, a piston received inside the cylinder, and a plurality of one-way valves, the valves operable so that relative axial motion of the piston with respect to the cylinder causes fluid to be drawn through the pump, and a sleeve disposed about the pump, the pump being rotatable inside the sleeve, wherein the improvement comprises:

a swivel disposed inside the sleeve with a fluid seal formed between the sleeve and the swivel, the swivel being rotatable inside the sleeve; and wherein the swivel includes structure defining a flow channel through the swivel, and wherein the flow channel is in fluid communication with the pump.

11. The fluid dispenser of claim 10, further comprising a connecting tube between the swivel and the pump, wherein fluid communication between the swivel and the pump is provided by the connecting tube.

12. The fluid dispenser of claim 10, wherein the fluid seal between the sleeve and the swivel is provided by an O-ring.

13. The fluid dispenser of claim 10, wherein the swivel is substantially fixed with respect to the pump, and wherein the swivel is rotatable with respect to the sleeve.

14. The fluid dispenser of claim 10, wherein the sleeve comprises a primary sleeve portion and a sleeve extension joined to the primary sleeve portion.

15. The fluid dispenser of claim 14, wherein the pump is disposed inside the primary sleeve portion, and wherein the swivel is disposed inside the sleeve extension.

16. The fluid dispenser of claim 10, wherein the swivel comprises a swivel body and a swivel outlet, and wherein the swivel outlet is in fluid communication with the pump.

17. The fluid dispenser of claim 14, wherein each of the primary sleeve portion and the sleeve extension is a separate component, and wherein the primary sleeve portion and the sleeve extension are assembled together to form the sleeve.

18. The fluid dispenser of claim 17, further comprising a locking screw operable to hold the primary sleeve portion and the sleeve extension together.

* * * * *